US007690435B2

(12) United States Patent
Jones et al.

(10) Patent No.: US 7,690,435 B2
(45) Date of Patent: Apr. 6, 2010

(54) WELLHEAD HOLD-DOWN APPARATUS AND METHOD

(75) Inventors: Bill D. Jones, Friendswood, TX (US); Mark D. Robson, Houston, TX (US)

(73) Assignee: Specialty Rental Tools & Supply, L.P., Alvin, TX (US)

( * ) Notice: Subject to any disclaimer, the term of this patent is extended or adjusted under 35 U.S.C. 154(b) by 0 days.

(21) Appl. No.: 11/571,709

(22) PCT Filed: Jul. 7, 2005

(86) PCT No.: PCT/US2005/024103

§ 371 (c)(1),
(2), (4) Date: Jan. 5, 2007

(87) PCT Pub. No.: WO2006/014544

PCT Pub. Date: Feb. 9, 2006

(65) Prior Publication Data

US 2008/0093087 A1 Apr. 24, 2008

Related U.S. Application Data

(60) Provisional application No. 60/586,010, filed on Jul. 7, 2004.

(51) Int. Cl.
*E21B 19/00* (2006.01)

(52) U.S. Cl. ..... 166/379; 166/85.1; 166/85.5

(58) Field of Classification Search ..... 166/84.1, 166/75.11, 75.13, 85.1, 85.4, 85.5, 379; 285/18, 285/123.1

See application file for complete search history.

(56) References Cited

U.S. PATENT DOCUMENTS

| | | | | |
|---|---|---|---|---|
| 3,831,676 | A * | 8/1974 | Brown et al. | 166/84.2 |
| 4,127,167 | A * | 11/1978 | Arendt | 166/85.1 |
| 4,836,289 | A * | 6/1989 | Young | 166/379 |
| 5,279,365 | A * | 1/1994 | Yenulis et al. | 166/84.3 |
| 7,163,054 | B2 * | 1/2007 | Adams | 166/75.13 |
| 7,380,590 | B2 * | 6/2008 | Hughes et al. | 166/84.3 |

* cited by examiner

*Primary Examiner*—Kenneth Thompson
(74) *Attorney, Agent, or Firm*—David B. Dickinson

(57) ABSTRACT

An apparatus (100) and method for removably mounting a lubricator assembly (106) to a component of the wellhead stack. The component of the wellhead stack is an annular blowout preventer (BOP) (50). Tool and communication conduit lubrication and access to the wellbore without requiring activation of the packing element of the BOP (50).

14 Claims, 5 Drawing Sheets

WELLHEAD HOLD-DOWN APPARATUS AND METHOD

BACKGROUND OF THE INVENTION

Well drilling operations are typically performed through a long assembly of threadably connected pipe sections called a drillstring. Often, the drillstring is rotated at the surface by equipment on the rig thereby rotating a drill bit attached to a distal end of the drillstring downhole. Weight, usually by adding heavy collars behind the drill bit, is added to urge the drill bit deeper as it is rotated. Because subterranean drilling generates a lot of heat and cuttings as the formation below is pulverized, drilling fluid, or mud, is pumped down to the bit from the surface.

Typically, drill pipe sections are hollow and threadably engage each other such that the bores of adjacent pipe sections are hydraulically isolated from the "annulus" formed between the outer diameter of the drillstring and the inner diameter of the wellbore (either cased or as-drilled). Drilling mud is then typically delivered to the drill bit through the bore of the drillstring where it is allowed to lubricate the drill bit through ports and return with any drilling cuttings through the annulus. Because the drillstring and wellbore are often several thousand feet in depth, a tremendous amount of pressure is required to pump the drilling mud down to the bit and back up to the surface in a complete cycle. It is not unheard of for drilling mud pressures to exceed 20,000 pounds per square inch at these depths. Because of safety concerns, a device called an annular blowout preventer ("BOP") is often used. The annular BOP is used to seal the gap in the annulus between the drillstring and the borehole in the event of a downhole "kick" attributed to a gas pocket or other subterranean event. The annular BOP is designed to be quickly activated to prevent such kicks from spewing wellbore fluids and hazardous gasses into the atmosphere at the well site.

Frequently, measurements of formation density, porosity, and permeability are taken before a well is drilled deeper or before a change in drilling direction is made. Often, measurements relating to directional surveying are needed to ensure the wellbore is being drilled according to plan. These measurements and operations can be performed with a measurement while drilling assembly (MWD), whereby the measurements are made in real-time at or proximate to the drill bit and subsequently transmitted to operators at the surface through mud-pulse or electromagnetic-wave telemetry. While MWD operations are possible much of the time, manual measurements are often desired either for verification purposes, or the measurements desired are not within the capabilities of the MWD system. For this reason, measurements are often required by "wireline" or other devices absent the presence of the drillstring. Various tools, communications conduits, and method are used in the oilfield today to perform measurements or other operations.

For the purpose of this disclosure, the term "tool" is generic and may be applied to any device sent downhole to perform any operation or measurement. Particularly, a downhole tool can be used to describe a variety of devices and implements to perform a measurement, service, or task, including, but not limited to, pipe recovery, formation evaluation, directional measurement, and workover. Furthermore, the term communications "conduit," while frequently thought of by the lay person as a tubular member for housing electrical wires, in oilfield parlance, is used to describe anything capable of transmitting fluid, force, electrical, or light communications from one location (e.g. surface) to another (e.g. downhole). For this reason, the term conduit, as applied with respect to the present disclosure includes, but is not limited to, wireline, slick line, fiber optic cable, and any present or future equivalents thereof.

Therefore, a need exists for a device and method to allow a variety of tools and communications conduits to enter a pressurized wellbore to perform operations and take measurements. The device would preferably be capable of being quickly and easily removed when not needed and would be configured to attach to a component of the wellhead stack, including, but not limited to, annular BOP's, ram-type BOP's, and wellhead valves.

BRIEF SUMMARY OF THE INVENTION

The deficiencies of the prior art are addressed by an apparatus to be mounted to a wellhead stack. The apparatus preferably includes a hold-down retainer affixed to a component of the wellhead stack wherein the hold-down retainer includes a locking profile. The apparatus preferably includes a hold-down mandrel having an engagement profile. The engagement profile is preferably configured to be retained by the locking profile when the mandrel is in a locked position. The engagement profile is preferably configured to be axially displaced with respect to the locking profile when the mandrel is in an unlocked position. The apparatus preferably includes a lubricator assembly extending upward from the mandrel.

The deficiencies of the prior art are also addressed by an apparatus to be mounted to a wellhead stack wherein the hold-down retainer includes a locking profile and a sealing surface. The apparatus preferably includes a hold-down mandrel wherein the mandrel has an engagement profile and a hydraulic seal. The engagement profile is preferably configured to be retained by the locking profile when the mandrel is in a locked position. The engagement profile is preferably configured to be axially displaced with respect to the locking profile when the mandrel is in an unlocked position. The apparatus preferably includes a lubricator assembly extending upward from the mandrel.

The deficiencies of the prior art are also addressed by a method to attach a communications tool lubricator assembly to a wellhead stack. The method preferably includes attaching a hold-down retainer to a component of the wellhead stack, wherein the retainer includes a locking profile. The method also preferably includes mounting the lubricator assembly to a proximal end of a hold-down mandrel, wherein the mandrel includes an engagement profile on an outer surface. The method preferably includes engaging the mandrel into the retainer, wherein the engagement profile is preferably configured to engage the locking profile and retain the mandrel. The method also preferably includes preventing the escape of borehole fluids from the wellhead stack through the use of a sealing mechanism between the mandrel and the retainer.

The deficiencies of the prior art are also addressed by an apparatus to allow the insertion of tools through a wellhead stack. The apparatus preferably includes a hold-down retainer secured to the wellhead stack wherein the hold-retainer includes a locking profile. The apparatus preferably includes a mandrel having an engagement profile, wherein the engagement profile is configured to be retained by the locking profile when the mandrel is in a locked position. Preferably, the engagement profile is configured to be removed from the locking profile when the mandrel is in an unlocked position. The apparatus preferably includes a lubricator assembly extending upward from the mandrel, wherein the lubricator is configured to house the tools to be inserted through the wellhead stack.

DETAILED DESCRIPTION OF THE PREFERRED EMBODIMENTS

Figure 1:
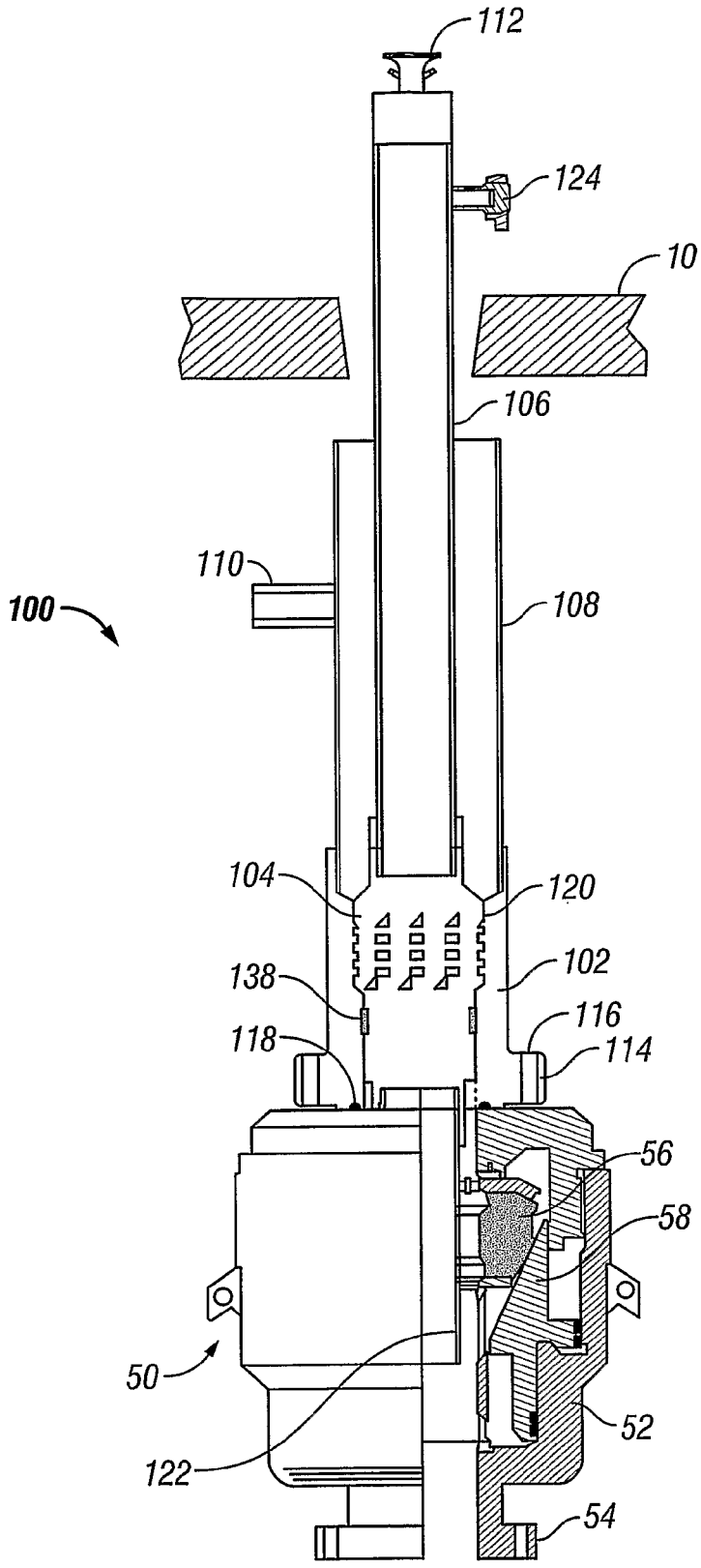
FIG. 1 is a schematic profile drawing of a hold-down apparatus in accordance with a preferred embodiment of the present invention, shown engaged with an annular blow out preventer apparatus.

Referring initially to FIG. 1, a hold-down apparatus 100 in accordance with a preferred embodiment of the present invention is shown below a rig floor 10 mounted atop an annular blow out preventer 50. Annular BOP 50 typically includes a main body 52, a mounting flange 54, a packing element 56, and a compression piston 58. BOP 50 is mounted atop the wellhead or other equipment (not shown) by bolted flange 54. Annular BOP serves to seal off the annulus between a pipe or tubing string engaged therethrough and a borehole in the event of a downhole surge in pressure or "kick." Hydraulic pressure is maintained in BOP 50 to drive piston 58 into packing element 56 to compress it against anything engaged therethrough. In the event of a sudden increase in pressure, BOP 50 can be configured so that piston 58 compresses packing element 56 even tighter as annular pressure increases such that the escape of annular fluids is prevented.

Referring still to FIG. 1, the hold-down apparatus 100 preferably is mounted atop annular BOP 50. Hold-down apparatus 100 preferably includes a hold-down retainer 102, a hold-down mandrel 104 with an attached lubricator 106, a bell nipple 108 with a flowline connection 110, and a hydraulic packoff device 112. Hold-down retainer 102 is shown with a bolting flange 114 having a plurality of bolt holes 116 for securing retainer 102 to the top of BOP 50, but any means well known to those of skill in the art for connecting retainer 102 to a BOP 50 or other wellhead component may also be used, such as quick-connect flanges and the like. A hydraulic seal 118 is preferably provided to prevent the escape of fluids from the interface between BOP 50 and hold-down retainer 102. From retainer 102, bell nipple 108 extends upward towards rig floor 10 and provides a flowline connection 110 for the removal of fluids therefrom. Retainer 102 also provides a receptacle 120 wherein hold-down mandrel 104 is engaged and locked into place. Hold-down mandrel 104 preferably includes a lubricator housing 106 and a stinger mandrel 122 attached thereto.

Lubricator housing 106 can be a tube-shaped body long enough to completely enclose a tool to be engaged within the bore below BOP 50. Lubricator 106 can include packoff 112 at its top and a pressure regulator 124 to remove pressure or fluids from inside lubricator 106. Dual packoff systems can also be used where lubricator housing 106 does not completely enclose the tool. Packoff 112 is preferably constructed to allow the "stripping" in and out therethrough of communications conduit (wireline, slickline, fiber optic, etc.) and any tools disposed thereon with little or no bore or well fluids escaping therethrough. However, packoff 112 may also be constructed to only allow communications conduit therethrough, whereby any tools to be used with lubricator 106 are "made up" on the rig floor after the conduit is engaged through packoff 112. Ideally, the communications conduit (and attached tools) is engaged through packoff 112, through lubricator 106, mandrel 104, stinger 122, BOP 50, and into the wellbore below.

Figure 2:
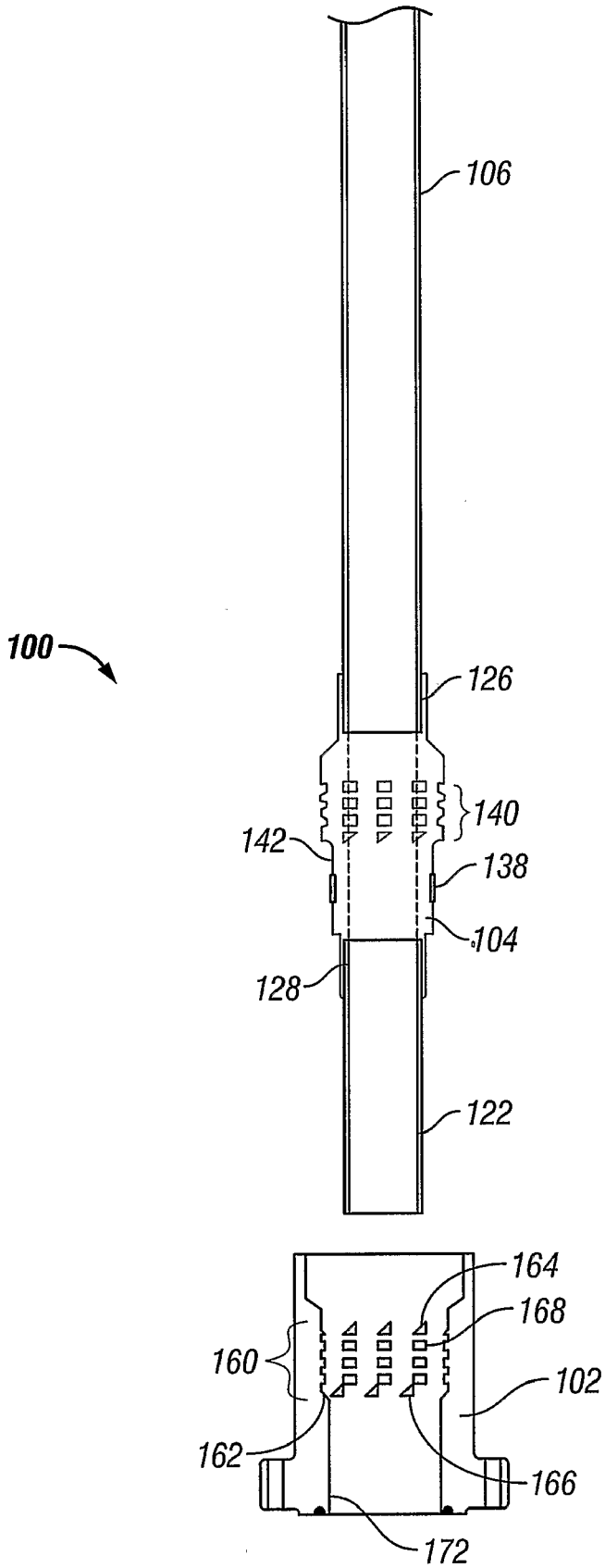
FIG. 2 is a schematic representation of the hold-down apparatus of FIG. 1.

Referring now to FIG. 2, a schematic drawing of hold-down assembly 100 is shown. As can be seen more clearly than in FIG. 1, hold-down assembly 100 includes hold-down retainer 102, hold-down mandrel 104, lubricator assembly 106, and stinger 122. Lubricator 106 and stinger 122 are preferably threadably engaged within hold-down mandrel 104 at respective threaded connections 126 and 128. Threaded connections 126 and 128 are preferably constructed to be high tensile strength sealed connections.

Figure 4:
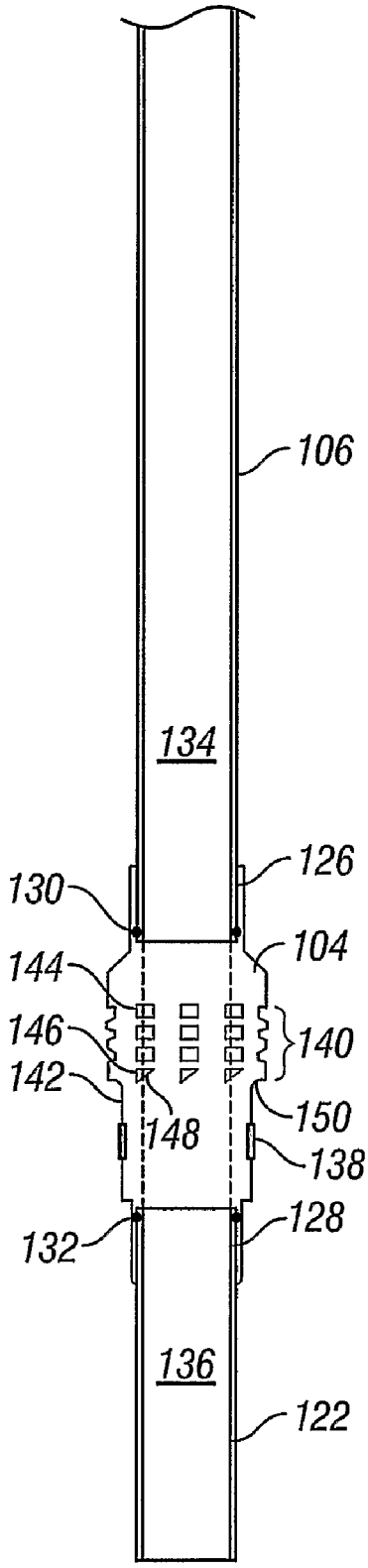
FIG. 4 is a schematic representation of a hold-down mandrel with an attached lubricator of FIG. 2.
Figure 5:
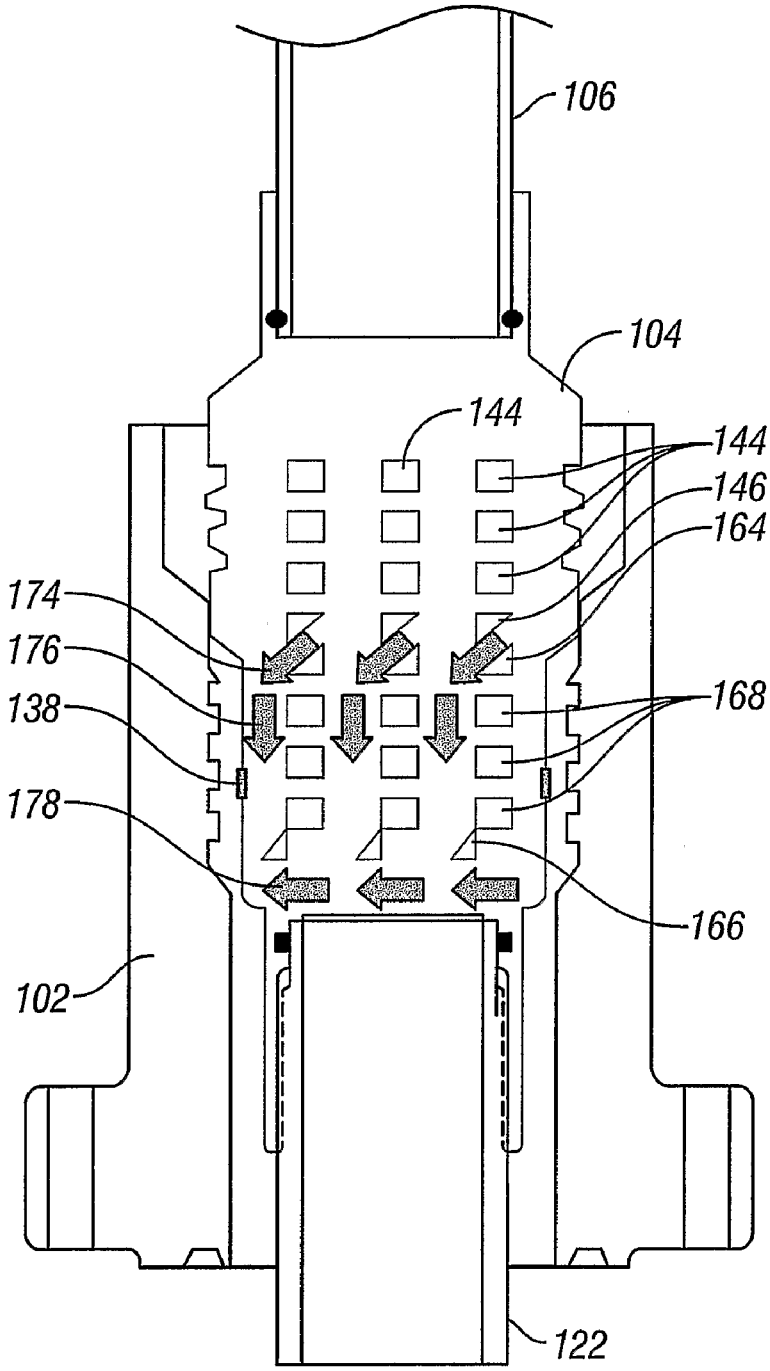
FIG. 5 is a schematic representation of the locking mechanism of the hold-down retainer and mandrel of FIGS. 1-4.

Referring to FIGS. 2 and 4, elastomeric seals 130 and 132 can prevent fluids within bores 134 and 136 of lubricator 106 and stinger 122 from escaping through connections 126 and 128. Hold-down mandrel 104 preferably includes a seal member 138 and an engagement profile 140 upon an outer surface 142 to enable mandrel 104 to latch into sealing engagement with hold-down retainer 102. Seal member 138 can provide an integral seal between the hold-down retainer 102 and the hold down mandrel 104, providing additional leak protection over systems which rely solely on the BOP 50 as the pressure seal.

Engagement profile 140 is shown including a plurality of aligned locking dogs 144, and rotation elements 146. Rotation elements 146 are configured to rotate hold-down mandrel 104 into either a locking or unlocking alignment with hold-down retainer 102. Angled planes 148 of rotation elements 146 induce a torque into hold-down mandrel 104 when axially loaded, thereby rotating mandrel 104 into alignment. Locking dogs 144 are spaced such that when engaged into hold-down mandrel 104 and locked into position, their shear strength prevents removal of hold-down mandrel 104 therefrom. A seating profile 150 bottoms out and prevents further engagement of mandrel 104 within retainer 102 when properly seated.

Figure 3:
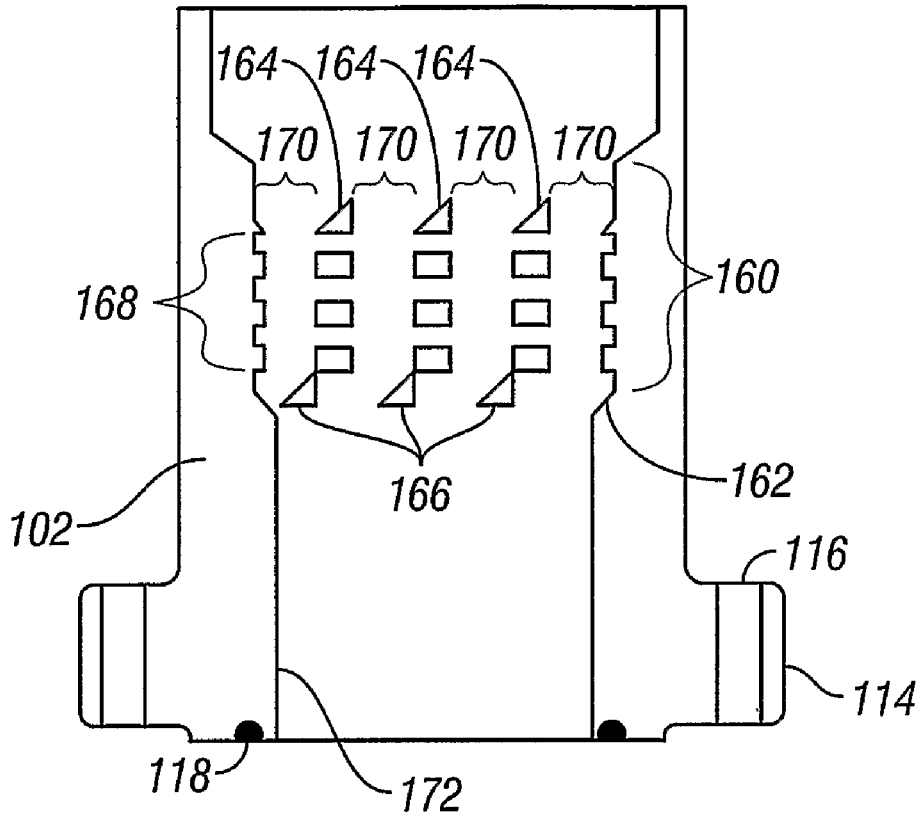
FIG. 3 is a schematic representation of a hold-down retainer of FIG. 2.

Referring to FIGS. 2 and 3 together, hold-down retainer 102 includes a locking profile 160 and a seat 162. Locking profile 160 includes two sets of rotation elements, alignment elements 164, and locking elements 166. Profile 160 also includes a plurality of locking dogs 168. Alignment elements 164 act in conjunction with rotation elements 146 of FIG. 4 to align locking dogs 144 of mandrel 104 with axial gaps 170 between locking dogs 168 of retainer 102. Furthermore, hold-down retainer 102 includes a seal bore 172 for sealing engagement with seal 138 of mandrel 104. Alternatively, seal bore 172 of retainer 102 and seal member 138 of mandrel 104 can be reversed so that seal member 138 is on retainer 102 and a sealing surface is on the periphery of mandrel 104. Furthermore, specific configurations of seal member 138 and bore 172 can be of any type known by one skilled in the art including, but not limited to, elastomeric seals, metal-to-metal seals, or polymeric seals.

Referring to FIGS. 2-5 together, the engagement of hold-down mandrel 104 into hold-down retainer 102 can be described. Hold-down mandrel 104 is engaged within bore 172 of hold-down retainer 102 until rotation elements 146 of mandrel 104 engage alignment elements 164 of retainer 102. When loaded axially, angled planes 148 of mandrel 104 engage alignment elements 164 and urge rotation of mandrel 104 in direction shown at arrow 174. Once this rotation is complete, locking dogs 144 of mandrel 104 are aligned with gaps 170 of retainer 102 and mandrel 104 is able to continue engaging bore 172 of hold-down retainer 102 in direction of arrow 176. As mandrel 104 is engaged further, angled planes 148 of rotation elements 146 engage locking elements 166 of retainer 102. Like alignment elements 164, locking elements 166 urge the rotation of mandrel 104 in the rotational direction of arrow 178. As this locking step is necessary to secure engagement of mandrel 104 into retainer 102 for this particular embodiment for profiles 140 and 160, external torque in the direction of arrow 178 may need to be applied to mandrel 104 or lubricator 106. The final rotation of mandrel 104 in direction of arrow 178 when rotation elements 146 engage locking elements 166 rotates locking dogs 144 of mandrel 104 between axial gaps 170 between locking dogs 168 of hold-down retainer 102.

With locking dogs 144 and 168 so intertwined, their shear strength is capable of resisting forces that would otherwise separate hold-down mandrel 104 from hold-down retainer 102. To unlock mandrel 104 from retainer 102, mandrel 104 is rotated counter to direction arrow 178 and is lifted out of retainer 102 when dogs 144 or mandrel 104 are aligned with gaps 170 between dogs 168 of retainer 102.

Hold-down system 100 has many applications and uses. Preferably, hold-down retainer 102 with attached bell nipple 108 and flowline connection 110 are installed atop the annular BOP 50 in the beginning of drilling operations for use with hold-down mandrel 104 at a later time. Alternatively, other designs of BOP's may be used in place of annular BOP 50. With retainer 102 and bell nipple 108 in place, operations continue as usual until an entry operation is desired. For a typical wireline operation, mandrel 104, with lubricator 106 and stinger 122, can be inserted and locked within the hold-down retainer 102. Packoff 112 can be removed from the top of lubricator 106, allowing access to the full bore of lubricator 106. Wireline can be threaded through packoff 112 and attached to a tool. The tool can then be run through lubricator 106 and packoff 112 reinstalled atop lubricator 106.

Usually, to effectuate the installation of lubricator 106 and mandrel 104 into annular BOP 50, a ram-type BOP (not shown) or other form of shutoff valve is closed below the annular BOP 50. Then, the activation pressure of annular BOP 50 is relaxed, thus allowing stinger 122 mounted below mandrel 104 to be engaged within packing element 56 of BOP 50. As stinger 122 engages packing element 56, profiles 140 and 160 engage one another and mandrel 104 and lubricator 106 are rotated until locking engagement of mandrel 104 with retainer 102 is achieved. Once locked into place, a ram-type BOP or other valve devices below can be opened without the risk of wellbore fluids escaping. Seal 118 at flange 114 of retainer 102 prevents leakage between retainer 102 and BOP 50. Seal 138 of mandrel 104 prevents leakage between mandrel 104 and retainer 102. Seals 130 and 132 prevent leakage between mandrel 104 and lubricator 106 and stinger 122. Finally, packoff 112 atop lubricator 106 prevents leakage around communications conduit. Therefore, the packing element 56 of annular BOP 50 does not need to be energized to prevent the leakage of fluids from the wellbore. With lubricator 106 and mandrel 104 installed within retainer 102, the tools lubricated within can now be deployed downhole.

The present invention has several concomitant advantages, two of which are the provision of additional leak protection and the ease of installation. The present invention provides an integral seal between the hold-down retainer and the hold-down mandrel, which adds additional leak protection over systems which rely solely on the BOP as the pressure seal. The lock-down system of the present invention can also allow installation from the rig floor, thereby avoiding the need for an operator to go below the rig floor during installation.

While a preferred embodiment for the locking mechanism of hold-down assembly 100 is shown, it should be understood by one skilled in the art that departures from the specific embodiment disclosed can still be within the scope and meaning of the invention as claimed. For example, mechanisms that include hydraulic or electrical actuation mechanisms can be used in place of the "inclined plane" system disclosed herein to lock the hold-down mandrel to the hold-down retainer.

What is claimed is:

1. An apparatus to be mounted to a wellhead stack, the apparatus comprising:
- a hold-down retainer affixed to a component of the wellhead stack, the hold-down retainer having a locking dogs profile;
- a hold-down mandrel having locking dogs for engagement with the hold-down retainer;
- a seal configured between a surface of the hold-down mandrel and a surface of the retainer to prevent the escape of well fluids;
- an engagement profile configured to be retained by the locking dogs profile when the hold-down mandrel is in a locked position;
- the engagement profile configured to be axially displaced with respect to said locking dogs profile when said hold-down mandrel is in an unlocked position; and
- a lubricator assembly extending upward from said hold-down mandrel.

2. The apparatus of claim 1 wherein said locking dogs include inclined plane surfaces to facilitate engagement and disengagement of said engagement profile with said locking profile.

3. The apparatus of claim 1 further comprising a stinger attached to a distal end of said hold-down mandrel.

4. The apparatus of claim 3 wherein said stinger is configured to seal with a packing element of an annular blowout preventer.

5. The apparatus of claim 3 wherein said stinger is removably attached to said distal end of said hold-down mandrel.

6. The apparatus of claim 1 wherein said lubricator, hold-down mandrel, and hold-down retainer are configured to prevent fluids from the wellhead stack from escaping without assistance from a packing element of an annular blowout preventer.

7. The apparatus of claim 1 further comprising a removable bell nipple extending upward from said hold-down retainer.

8. An apparatus to be mounted to a wellhead stack, the apparatus comprising:
- a hold-down retainer affixed to a component of the wellhead stack, said hold-down retainer having a locking profile in a longitudinal bore thereof;
- a hold-down mandrel having an engagement profile on an exterior surface thereof;
- a lubricator assembly extending upward from said hold-down mandrel;
- the engagement profile comprising a plurality of radially spaced rotational elements disposed on a distal end of the hold-down mandrel and a plurality of axial rows of mandrel locking dogs, each row of mandrel locking dogs axially aligned with a rotational element; and
- the locking profile comprising a plurality of radially spaced alignment elements disposed adjacent a proximal end of the longitudinal bore, a plurality of axial rows of retainer locking dogs to interlock with the plurality of axial rows of mandrel locking dogs, each row of retainer locking dogs axially aligned with an alignment element, and a plurality of radially spaced locking elements disposed at a distal end of the longitudinal bore axially offset from the retainer locking dogs to impart rotation to the hold-down mandrel to interlock the locking dogs of the mandrel and the retainer when the mandrel is axially displaced into the retainer.

9. The apparatus of claim 8 wherein the rotational element comprises an angled surface aligning the hold-down mandrel and the retainer into an engaging orientation when the angled surface is axially displaced into contact with an opposingly angled surface of the alignment element, and rotating the locking dogs of the hold-down mandrel and the retainer into an interlocking arrangement when the angled surface is axially displaced into contact with an opposingly angled surface of a locking element.

10. An apparatus to allow the insertion of tools through a wellhead stack, the apparatus comprising:

a hold-down retainer secured to the wellhead stack, the hold-down retainer includes a locking profile having locking dogs and said locking dogs include inclined plane surfaces;

a mandrel having an engagement profile having locking dogs and said locking dogs having inclined plane surfaces to facilitate engagement and disengagement of said engagement profile with said locking profile, wherein said engagement profile is configured to be retained by said locking profile when said mandrel is in a locked position;

said engagement profile configured to be removed from said locking profile when said mandrel is in an unlocked position; and a lubricator assembly extending upward from said mandrel, said lubricator configured to house the tools to be inserted through the wellhead stack.

11. The apparatus of claim 10 wherein said wellhead stack includes an annular blowout preventer.

12. The apparatus of claim 11 further comprising a stinger attached to a distal end of said mandrel.

13. The apparatus of claim 12 wherein said stinger is configured to seal with a packing element of said annular blowout preventer.

14. The apparatus of claim 12 wherein said stinger is removably attached to said distal end of said mandrel.

* * * * *